US009464865B2

(12) United States Patent
Shea et al.

(10) Patent No.: US 9,464,865 B2
(45) Date of Patent: Oct. 11, 2016

(54) HAND GUARD INSTALLATION MECHANISM

(71) Applicant: RA Brands, L.L.C., Madison, NC (US)

(72) Inventors: Kiernan Shea, Brooks, KY (US); David O. Matteson, Horse Cave, KY (US); Marlin R. Jiranek, II, Elizabethtown, KY (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 14/593,549

(22) Filed: Jan. 9, 2015

(65) Prior Publication Data

US 2015/0316347 A1 Nov. 5, 2015

Related U.S. Application Data

(60) Provisional application No. 61/926,520, filed on Jan. 13, 2014.

(51) Int. Cl.
*F41C 23/16* (2006.01)

(52) U.S. Cl.
CPC ..... *F41C 23/16* (2013.01)

(58) Field of Classification Search
CPC ..... F41C 23/06; F41C 23/12; F41C 23/16; F41A 11/00; F41A 35/00; F41A 35/02
USPC ..... 42/71.01, 72, 75.01; 411/265, 277, 285
See application file for complete search history.

(56) References Cited

U.S. PATENT DOCUMENTS 241,466 A * 5/1881 Wilson ..... F41A 3/58 42/40
2,872,227 A * 2/1959 Wachs ..... F16D 1/02 403/379.4
2,874,504 A 2/1959 Martinek
4,354,322 A * 10/1982 Carone ..... F41A 3/58 411/24
4,845,871 A 7/1989 Swan
5,590,484 A 1/1997 Mooney et al.
5,945,626 A 8/1999 Robbins
6,295,754 B1 * 10/2001 Otteman ..... F41G 1/38 42/111
6,327,807 B1 12/2001 Bergacker
D477,855 S 7/2003 Selvaggio (Continued)

FOREIGN PATENT DOCUMENTS

WO WO 2010/151552 12/2010
WO WO 2013/010515 1/2013

OTHER PUBLICATIONS

Extended European Search Report dated Jun. 8, 2015 for European application 15150951.0.

(Continued)

*Primary Examiner* — Bret Hayes
(74) *Attorney, Agent, or Firm* — Womble Carlyle Sandridge & Rice, LLP

(57) ABSTRACT

A hand guard installation mechanism for securing a hand guard over the barrel of a firearm includes a tapered locking element that extends at least partially through the hand guard and interfaces with a surface of the barrel nut of the firearm. A fastener mates with the locking element, drawing the locking element at least farther into the hand guard and against the surface of the barrel nut. As the locking element is drawn against the barrel nut, the hand guard is tightened against the barrel nut such that the hand guard is secured in place against the receiver of the firearm.

25 Claims, 10 Drawing Sheets

(56) References Cited

U.S. PATENT DOCUMENTS

| | | | | |
|---|---|---|---|---|
| 6,655,069 | B2 | 12/2003 | Kim | |
| 6,820,361 | B2 | 11/2004 | Popikow | |
| RE40,216 | E | 4/2008 | Swan | |
| 7,523,580 | B1 | 4/2009 | Tankersley | |
| D604,793 | S | 11/2009 | Fitzpatrick et al. | |
| 7,669,359 | B2 | 3/2010 | Kim | |
| D613,811 | S | 4/2010 | Swan | |
| D616,521 | S | 5/2010 | Starnes | |
| 7,716,865 | B2 | 5/2010 | Daniel et al. | |
| 7,770,317 | B1 | 8/2010 | Tankersley | |
| 7,793,452 | B1 | 9/2010 | Samson et al. | |
| D631,933 | S | 2/2011 | Thompson | |
| 7,905,041 | B1 * | 3/2011 | Davies | F41A 3/66 42/75.02 |
| 7,908,784 | B2 | 3/2011 | Kim | |
| 7,921,760 | B2 | 4/2011 | Tankersley | |
| 7,941,959 | B1 | 5/2011 | Swan | |
| D639,376 | S | 6/2011 | Ding | |
| 8,201,353 | B1 | 6/2012 | Swan | |
| 8,528,246 | B2 | 9/2013 | Telles | |
| D692,516 | S | 10/2013 | Yan et al. | |
| 8,562,243 | B2 | 10/2013 | Dizdarevic | |
| 8,607,490 | B1 * | 12/2013 | Zinsner | F41C 23/16 42/71.01 |
| D703,286 | S | 4/2014 | Chen et al. | |
| 8,726,557 | B2 | 5/2014 | Stone et al. | |
| D715,885 | S | 10/2014 | Silvers et al. | |
| 8,863,426 | B1 * | 10/2014 | Zinsner | F41C 23/16 42/71.01 |
| 8,904,691 | B1 * | 12/2014 | Kincel | F41C 23/16 42/71.01 |
| 9,086,247 | B2 * | 7/2015 | Lessard | F41A 3/66 |
| 2005/0268513 | A1 | 12/2005 | Battaglia | |
| 2007/0266611 | A1 | 11/2007 | Stover | |
| 2010/0059032 | A1 | 3/2010 | Zadra | |
| 2010/0319231 | A1 | 12/2010 | Stone et al. | |
| 2011/0107643 | A1 * | 5/2011 | Fitzpatrick | F41C 23/16 42/72 |
| 2011/0126443 | A1 | 6/2011 | Sirois | |
| 2011/0192066 | A1 | 8/2011 | Kimmel et al. | |
| 2011/0214327 | A1 * | 9/2011 | Desomma | F41A 3/66 42/75.02 |
| 2012/0159828 | A1 | 6/2012 | Jarboe et al. | |
| 2012/0167434 | A1 | 7/2012 | Masters | |
| 2012/0186123 | A1 | 7/2012 | Troy et al. | |
| 2013/0276342 | A1 * | 10/2013 | Chvala | F41A 13/12 42/90 |
| 2014/0026459 | A1 * | 1/2014 | Yan | F41C 23/16 42/71.01 |
| 2014/0069406 | A1 | 3/2014 | Hastings | |
| 2014/0130390 | A1 * | 5/2014 | Geissele | F41C 23/16 42/71.01 |
| 2014/0165444 | A1 * | 6/2014 | Masters | F41A 21/484 42/75.02 |

OTHER PUBLICATIONS

Weaver 1" Quad-Lock 4x4 Weaver-Style Rings; www.midwayusa.com; http://www.midwayusa.com/product/147718344/weaver-1-quad-lock-4x4-weaver-style-rings; accessed Apr. 30, 2014.

UTG 1" Rings, Low, Weaver/Picatinny, Quick Lock; www.pyramidair.com; http://www.pyramidair.com/s/a/UTG__1__Rings__Low__Weaver__Picatinny__Quick__Lock/3568; accessed Apr. 30, 2014.

Tuff Zone Carbine Size & Mid. Length Free Float Hand Guard (8 & 7.8" / 225mm); www.amazon.com; http://www.amazon.com/TUFF-ZONE-Carbine-Length-FLOAT/dp/B007MAEW78; accessed 05/.

MI AR15/M16 Gen2 SS-Series One Piece Free Float Handguard; www.dbackpolice.com; http://www.dbackpolice.com/gun-hunting-shooting-accessories/gun-accessories/handguards/gen2-ss-.

Class 3 Sales Accessories; http://home.comcast.net/~gunruner1/acc.htm (Accessed Sep. 21, 2012).

Leapers H&K Handguard Picatinny/Weaver Rails MNT-P501; Optic Planet.com; htt;??www.opticsplanet.com/leapers-h-k-handguard-Picatinny-weaver-rails-mntp501.html?utm__source=google.

* cited by examiner

HAND GUARD INSTALLATION MECHANISM

CROSS-REFERENCE TO RELATED APPLICATION

This application claims the benefit of U.S. Provisional Application No. 61/926,520 filed Jan. 13, 2014, the entire disclosure of which is incorporated herein by reference.

FIELD OF THE INVENTION

The present invention generally relates to firearms and features thereof, and, in particular, to a mechanism for engaging and mounting a forward grip or hand guard to a firearm.

BACKGROUND

In many semiautomatic and/or fully automatic firearms driven by gas operating systems, the barrels of such firearms typically are surrounded by a hand guard or forward grip with the barrel generally mounted in a "free floating" arrangement out of contact with the hand guard. During use of the firearm, the hand guard or forward grip portion enables the operator to securely grip and support the firearm along the barrel portion thereof without coming into contact with the barrel, which can become extremely hot during the firing of the weapon. Additionally, the hand guard can provide for the mounting of rails, lights and other accessories along the firearm.

Typically, many firearm hand guards have been designed to be removable so as to enable access to the barrel and/or gas system of the firearm for purposes of cleaning and/or replacement of the barrel and/or gas system components of the firearm. Such removable hand guards often are fastened to the barrel nut and/or upper receiver of the firearm with bolts, clamps or other, similar fasteners. Since it generally is necessary that the hand guards be mounted in as tight and secure a mounting as possible, a series of fasteners or similar attachment mechanisms often are used to install conventional hand guards. However, such attachments can introduce difficulties in removing and/or tightly securing the hand guard to the upper receiver, especially in the field and often typically require that tools, such as wrenches, screwdrivers, etc., be readily available to the shooter for removing and/or tightly securing the hand guard. In addition, it is often necessary to remove the barrel nut and/or the entire barrel assembly to remove some hand guards for change-out or replacement of the hand guard.

Accordingly, a need exists for an attachment mechanism for attaching a hand guard or forward grip to a receiver of a firearm that addresses the foregoing and other related and unrelated problems in the art.

SUMMARY

One aspect of the disclosure is the provision of a system or mechanism for installing a hand guard on a firearm, wherein the mechanism seeks to enable a simpler, more efficient mounting of the hand guard in a stable and secure arrangement over the barrel of the firearm. The hand guard installation mechanism may include a barrel nut for attachment of the barrel to or adjacent the upper receiver of the firearm. The barrel nut may be generally in the form of an open-ended cylinder or sleeve having a first or proximal end that mounts to the upper receiver, a second, distal end through which the barrel is received, and a shoulder section. The shoulder section may extend around a longitudinal axis of the barrel nut, be located intermediate the first and second ends, and will generally define a first interfacing surface face. The hand guard also can include a central passage having a cylindrical inner diameter that generally mates with a cylindrical outer diameter of the barrel nut, with the barrel extending therethrough. The barrel nut further can be formed with an outer diameter that generally matches most conventional hand guards.

A locking element of the installation mechanism can have a body with a conical or tapered section generally defining a second interfacing surface for engaging the first interfacing surface of the shoulder section of the barrel nut. The body of the locking element can further include a bore defined at least partially thereinto or therethrough. The locking element can be received in and mate with a hole in the hand guard, wherein the hole may be in the form of a slot, aperture, or any other suitably configured hole. The locking element can be drawn against the barrel nut using a fastener, whereby the tapered or conical section (e.g., second interfacing surface) of the locking element interfaces with the shoulder section (e.g., first interfacing surface) of the barrel nut. As the locking element is drawn against the barrel nut by its engagement with the fastener, the hand guard can be urged and/or tightened against the receiver of the firearm and/or the barrel nut, to thus secure the hand guard against the receiver and/or the barrel nut. The locking element accordingly can act as a wedge that applies a clamping force between the barrel nut and hand guard.

In accordance with another aspect of the disclosure, the hand guard can include a body having opposite proximal and distal ends, and a length extending from the proximal end to the distal end; a lengthwise passage extending along the length of the hand guard; and at least one crosswise passage extending through a portion of the body of the hand guard, wherein the crosswise passage extends crosswise to the length of the hand guard. The crosswise passage can have an opening at each of outer sides of the portion of the body of the hand guard for at least partially receiving at least one fastener assembly, and there can be an opening between the crosswise passage and the lengthwise passage for allowing the at least one fastener assembly to extend into the lengthwise passage for at least partially mounting the hand guard.

In accordance with one aspect of this disclosure, the portion of the body of the hand guard comprises a lower portion of the hand guard, and the lower portion of the hand guard can include a grooved, undulating or otherwise contoured outer surface that at least partially defines a plurality of finger grip protrusions and at least one finger grip recess between a pair of finger grip protrusions. A finger grip protrusion of the pair of finger grip protrusions can at least partially define the at least one crosswise passage.

The hand guard can be part of a hand guard attachment mechanism that further includes a barrel nut and at least one fastener assembly. The barrel nut can be configured for at least partially mounting a barrel to the receiver of a firearm. The at least one fastener assembly can be at least partially received in both the crosswise passage and the opening between the crosswise passage and the lengthwise passage. The at least one fastener assembly can include a tapered section that wedges between portions of the hand guard and the barrel nut for providing at least one mounting force between the hand guard and the barrel nut.

The at least one fastener assembly, hand guard and barrel nut also can be cooperatively configured so that the at least one mounting force comprises an axial mounting force and/or a radial mounting force between the hand guard and the barrel nut. The fastener draws the tapered section into a crosswise passage of the hand guard and at least into more forceful engagement with a shoulder of the barrel nut. The method can further include respectively introducing a locking element and a fastener into opposite openings of the crosswise passage of the hand guard. The axial mounting force also can be directed in a direction that extends along the longitudinal axis of the hand guard. The radial mounting force can be directed in a direction that extends crosswise to the length of the hand guard.

Various additional features, advantages, and embodiments of the disclosure may be set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

Various features, advantages and aspects of the present invention may be set forth or apparent from consideration of the following detailed description, when taken in conjunction with the accompanying drawings. Moreover, it will be understood that the accompanying drawings, which are included to provide a further understanding of the present disclosure, are incorporated in and constitute a part of this specification, illustrate various aspects, advantages and benefits of the present disclosure, and together with the detailed description, serve to explain the principles of the present disclosure. In addition, those skilled in the art will understand that, according to common practice, various features of the drawings as discussed below are not necessarily drawn to scale, and that dimensions of various features and elements of the drawings may be expanded or reduced to more clearly illustrate the embodiments of the present disclosure.

DETAILED DESCRIPTION

Figure 1:
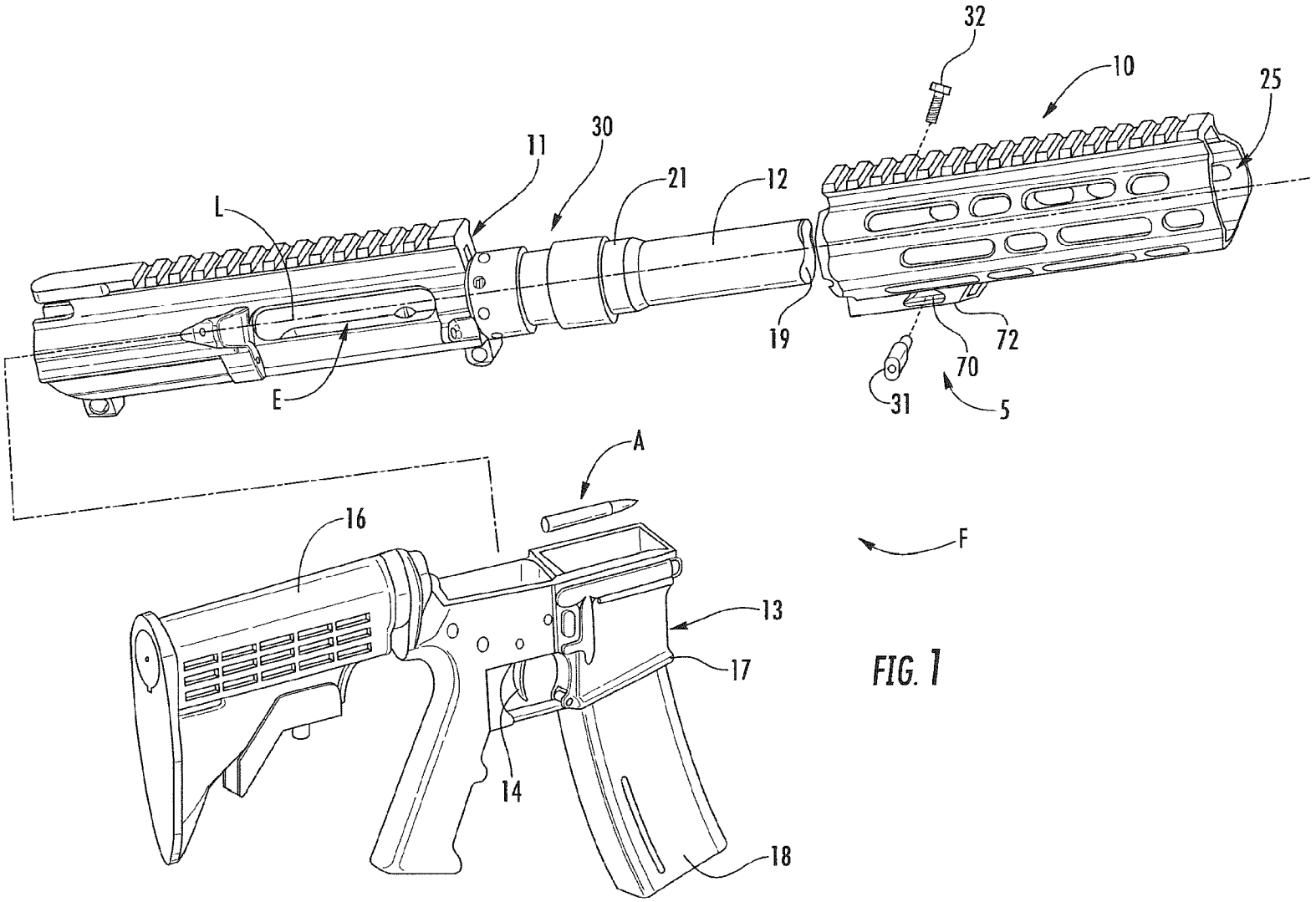
FIG. 1 is an exploded perspective illustration showing a firearm including a hand guard installation mechanism, according to an example that may be referred to as a first embodiment of this disclosure.

Referring now to the drawings in which like numerals indicate like parts throughout the several views, as shown in FIG. 1, the present invention generally is directed to a hand guard installation system or mechanism. For example, numeral 5 designates a hand guard installation system or mechanism that is for installing, securing, and/or mounting a forward grip or hand guard 10 to a firearm F, in accordance with an example that may be referred to as a first embodiment of this disclosure. As also illustrated in FIG. 1, the firearm F can comprise a semiautomatic or automatic rifle or other, similar firearm, although it will be understood by those skilled in the art that the hand guard installation system or mechanism 5 can be adapted for use with a variety of different firearms, including other types of rifles, shotguns and/or other long guns, as well as various types of handguns. For example, the firearm F can include firearms that utilize a direct gas impingement system or an indirect gas impingement system to eject a spent casing after firing the firearm. Examples of such types of firearms include the M16, the M4, AR-15 and other similar firearms. It will, therefore, be appreciated that the hand guard installation mechanism 5 can be adapted for use with generally any type of firearm F without departing from the nature and scope of the present invention.

As further illustrated in FIG. 1, an aspect of this disclosure is the provision of a simple, easy to use, but stable installation mechanism 5 for attaching the hand guard or forward grip 10 to or adjacent an upper receiver 11 of a firearm F, with the barrel 12 of the firearm being received in the hand guard 10 in a "floating" engagement (e.g., so that there may be an circumferential or cylindrical air gap between at least a portion of the hand guard 10 and the barrel 12). In the example or first embodiment shown in FIG. 1, the firearm F generally includes an upper receiver 11 defining a receiver bore extending along a longitudinal axis L, and housing a bolt, firing pin, and other firing components of the firearm. The longitudinal axis of the hand guard 10 may be coaxial with or substantially parallel to the longitudinal axis L, such that the longitudinal axis L may substantially be the longitudinal axis of the hand guard 10. As used herein, the phrase "along the longitudinal axis L" includes components and/or movements aligning with the longitudinal axis L and/or spaced from and substantially parallel to the longitudinal axis L. The upper receiver 11 further can include an ejection port E opening transverse to the longitudinal axis L for discharging spent casings. The firearm F can also include a lower receiver 13 that can be attached to the upper receiver 11, and generally can include a trigger or fire control 14, stock 16, and a magazine well 17. A magazine 18 will typically be detachably received within the magazine well 17 and can be loaded with a plurality of cartridges or rounds of ammunition "A." Referring to FIGS. 1-2, the barrel 12 of the firearm F generally is coupled to the upper receiver 11 and defines a barrel bore 19 extending along the longitudinal axis L. The barrel 12 will include a chamber portion 21 adjacent the upper receiver 11 and a muzzle spaced from the chamber along the longitudinal axis L.

Figure 2A:
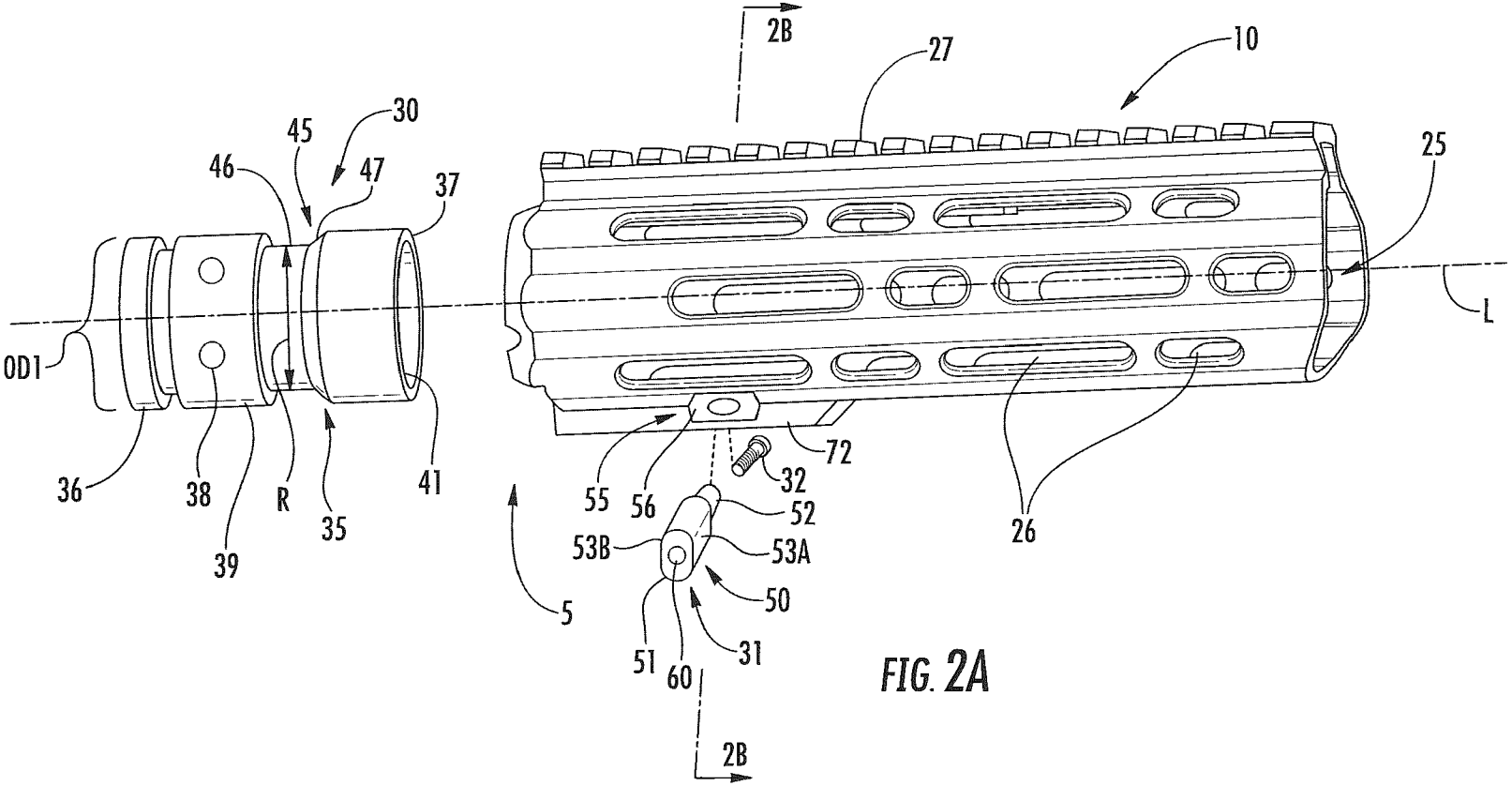
FIG. 2A is an exploded view of the barrel nut and hand guard of FIG. 1.
Figure 2B:
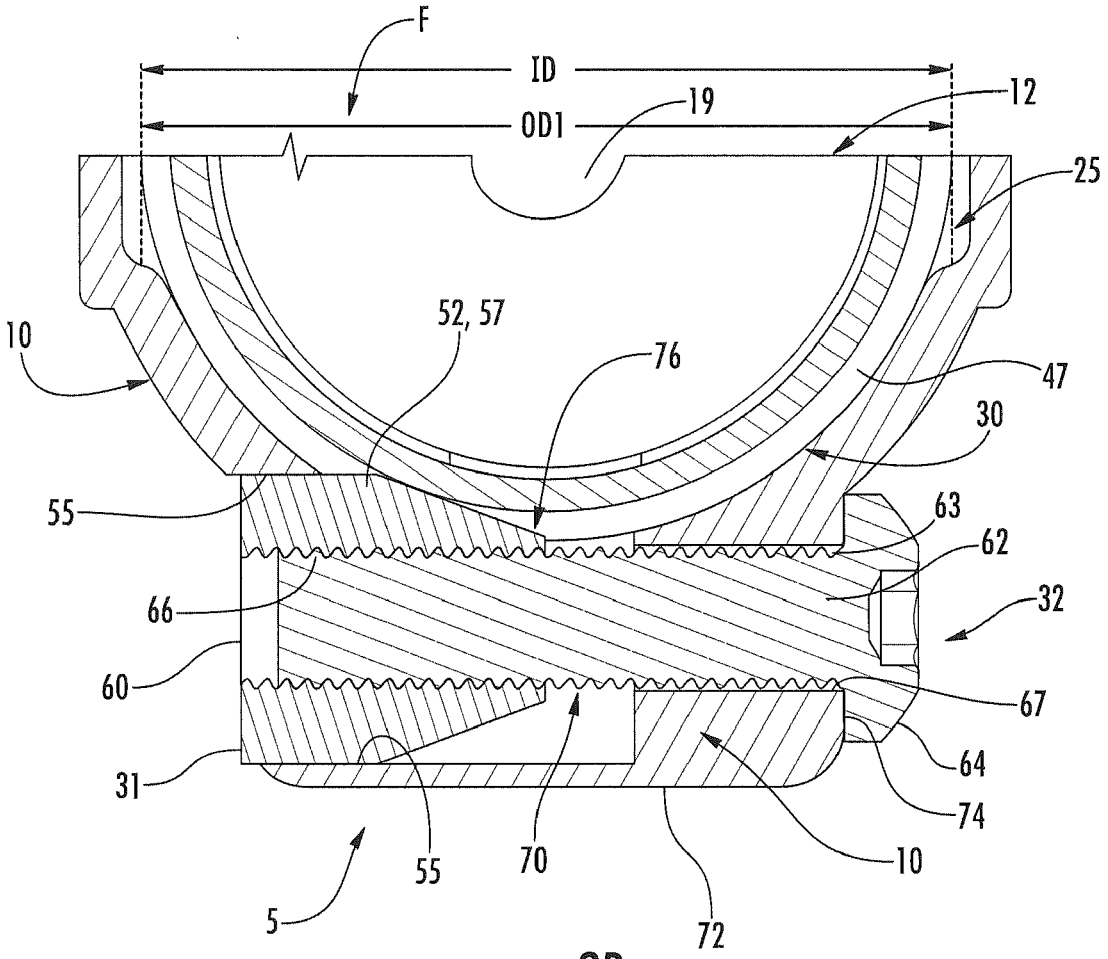
FIG. 2B is a schematic cross-sectional view of the assembled hand guard installation mechanism and associated components of the firearm taken substantially along line 2B-2B of FIG. 2A, showing the barrel nut and hand guard joined together by the locking element of the hand guard installation mechanism, in accordance with the first embodiment.

As shown in FIGS. 1-2B, the firearm F further will include a hand guard 10 that generally is mounted against or adjacent the upper receiver 11 of the firearm F, extending forwardly therefrom to enable a user to hold the firearm F by the hand guard 10 with the barrel 12 extending through the hand guard 10. For example, the hand guard 10 can surround the barrel 12 with the barrel 12 mounted in a "floating" type arrangement extending through a central passage or lengthwise channel 25 of the hand guard 10 that aligns with the longitudinal axis L of the firearm F. The hand guard 10 protects the user's hand from heat generated by the firing of the firearm F. The hand guard 10 can include a series of openings and/or slots 26, and further can include at least one rail 27 (such as a "Picatinny rail,") as well as other connection points as known in the industry for mounting additional components to the hand guard 10. For example, such components can include bipods, tripods, scopes, bayonets, lasers, shot guns, grenade launchers, etc.

According to the first embodiment, as shown in FIGS. 1-2B, the hand guard installation system or mechanism 5 includes a barrel nut 30, at least one locking element 31 that interfaces with the hand guard 10 and the barrel nut 30, and at least one fastener 32. In FIGS. 1 and 2A, the locking element 31 and fastener 32 are shown as being respectively "exploded away from" left and right sides of the hand guard 10. However and for example, the positions of the locking element 31, fastener 32 and associated features of the hand guard installation system or mechanism 5 may be reversed. In this regard, FIG. 2B is a cross-sectional view of at least the assembled the hand guard installation mechanism 5 taken along line 2B-2B of FIG. 2A, wherein FIG. 2B is schematic, for example, because it shows the locking element 31 and fastener 32 in reversed positions as compared to FIGS. 1 and 2A. As shown in some of the drawings, the fastener 32 can be an Allen-key or similar type of socket head screw or bolt, although any other suitable fastener 32 also may be used.

As shown in FIGS. 1-3C, the barrel nut 30 (e.g., mounting structure) generally will comprise an open ended, substantially cylindrical sleeve or body 35 having a first or proximal end 36 adapted to be received against and/or mounted to a barrel extension (not shown) or to the upper receiver 11 (FIG. 1) of the firearm F, such as by a threaded connection, and a second, downstream or distal end 37 through which the chamber end of the barrel will be received for connection of the barrel 12 to the upper receiver 11. A series of set screw or fastener openings 38 further can be provided about an intermediate section 39 of the barrel nut 30 for connection of the barrel nut 30 to the upper receiver 11 of the firearm. In addition, the open ended body 35 of the barrel nut 30 will define a central bore or passage 41 through which the chamber end of the barrel 12 will be received for mounting the barrel 12 to the upper receiver 11. This central bore 41 generally will be aligned with and will extend along the longitudinal central axis L of the firearm F, as illustrated in FIG. 2A.

Figure 3B:
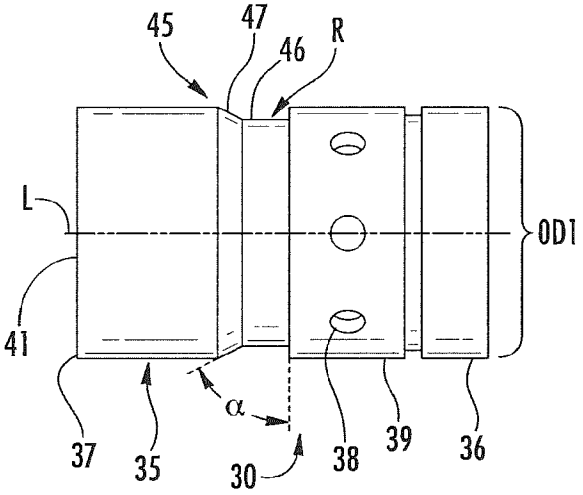
FIG. 3B is a side view of the barrel nut of FIG. 3A.
Figure 3C:
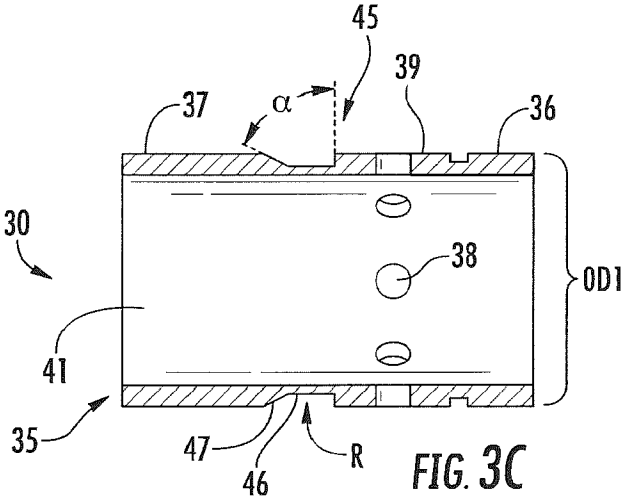
FIG. 3C is a cross-sectional view of the barrel nut of FIGS. 3A-3B.
Figure 3A:
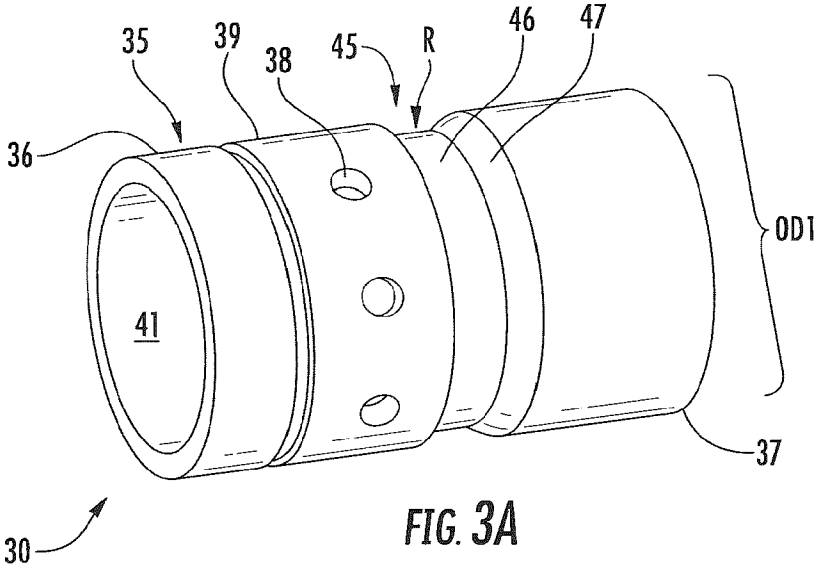
FIG. 3A is a perspective illustration of one embodiment of the barrel nut.
Figure 4A:
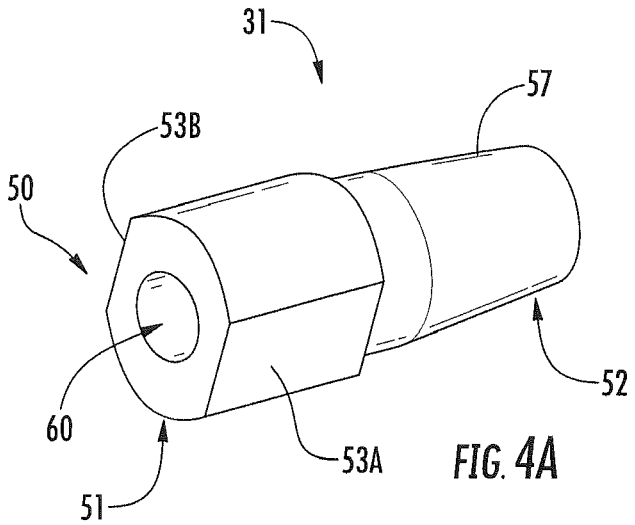
FIG. 4A is a perspective illustration of one embodiment of the locking element.
Figure 4B:
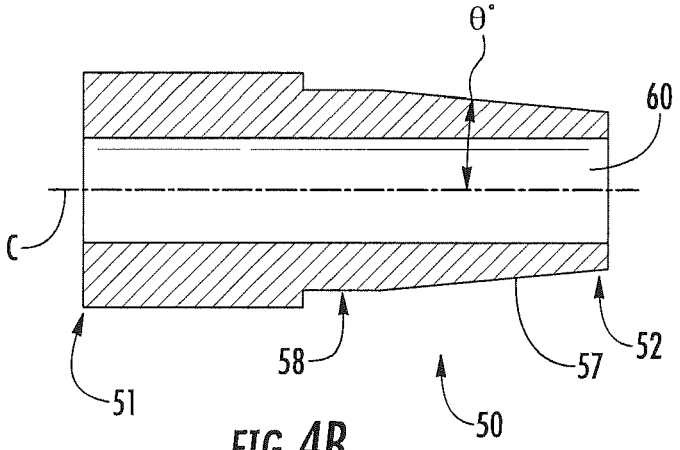
FIG. 4B is a side cross-sectional view of the locking element of FIG. 4A taken along line 4B-4B of FIG. 4C.
Figure 4C:
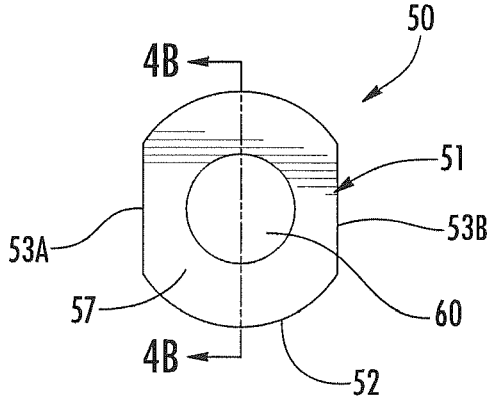
FIG. 4C is an end view of the locking element of FIG. 5A.
Figure 5A:
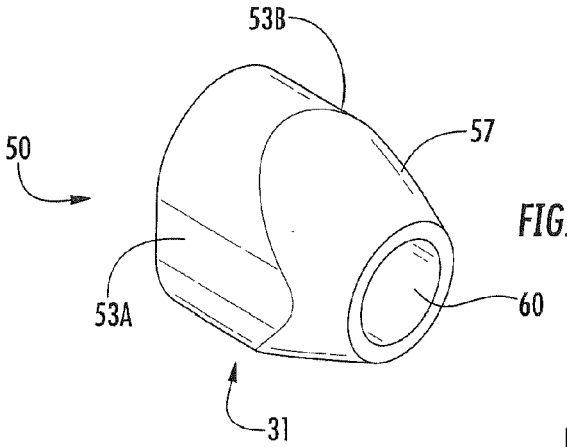
FIG. 5A is a perspective illustration of another embodiment of the locking element.
Figure 5B:
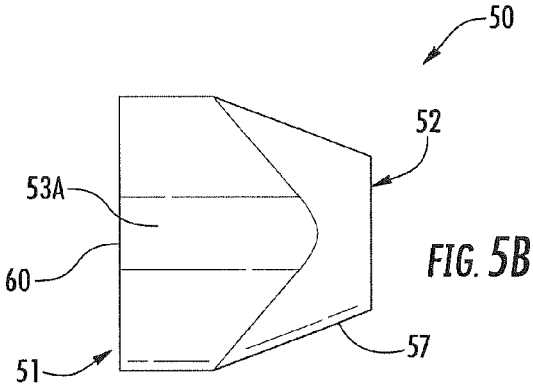
FIG. 5B is a side view of the locking element of FIG. 5A.
Figure 5C:
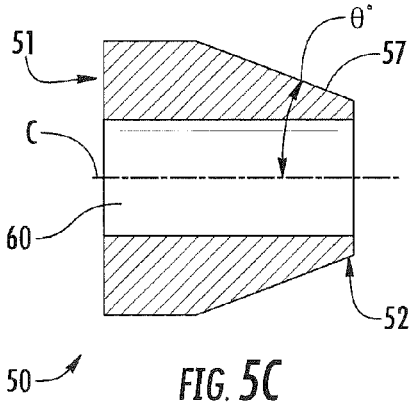
FIG. 5C is a side cross-sectional view of the locking element of FIG. 5A taken along line 5C-5C of FIG. 5D.
Figure 5D:
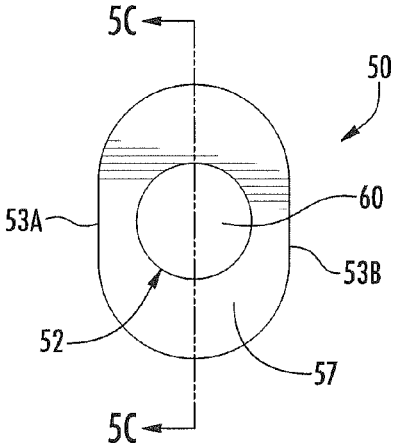
FIG. 5D is an end view of the locking element of FIGS. 5A-5B.
Figure 6A:
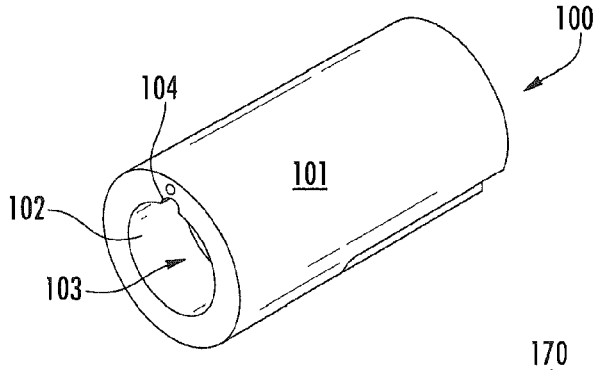
FIGS. 6A-6B are perspective illustrations of another example of a hand guard that can be installed on a firearm using the hand guard installation mechanism, according to a second embodiment.
Figure 6B:
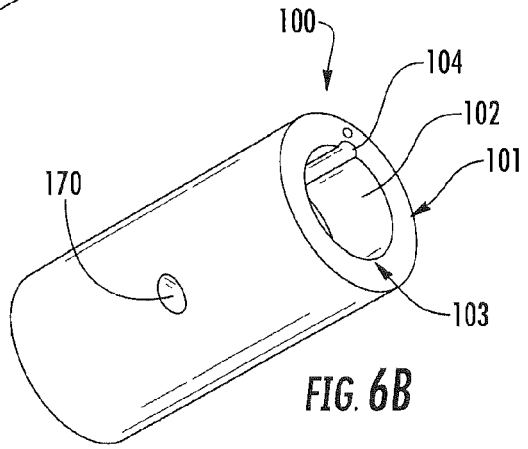

As FIGS. 3A-3C further illustrate, in the first embodiment, the barrel nut 30 additionally will include a tapered or conical section or shoulder portion 45 formed at a location spaced from the upstream or distal end 37 of the barrel nut 30, between the intermediate portion 39 and upstream, distal end 37 of the barrel nut 30. This conical or tapered section 45 will be of a reduced diameter, as indicated at R in FIGS. 3A-3C, and will include a recessed cylindrical section 46 and an inwardly tapering shoulder or conical surface 47 defining a first interfacing surface about the circumference of the barrel nut 30. The conical shoulder 47 generally can be arranged at an angle "a" (FIG. 3C), which can range from approximately 15-20° to approximately 30° in one embodiment. Other, greater or lesser angles for the first interfacing, or tapering surface 47 of the barrel nut 30 also can be provided as needed or desired without departing from the scope of the present disclosure. For example, the shoulder 47 may alternatively extend perpendicularly relative to the longitudinal axis L or in any other suitable configuration. The first and second ends 36, 37 and intermediate portion 39 of the barrel nut 30 further generally can have a substantially consistent outer diameter OD1 that is greater than the diameter R of the reduced diameter or recessed body section 46, as illustrated in FIGS. 3A-3C. Alternatively, the barrel nut 30 may be replaced with a conventional barrel nut for being engaged by the locking element 31. For example, the locking element 31 may be configured for wedging against a variety of differently configured barrel nuts.

FIGS. 4A-5D illustrate various examples of the locking element 31 that can be used in the hand guard installation mechanism 5 according to various embodiments, such as the first embodiment of the installation mechanism. As indicated in FIGS. 4A-5C, the locking element 31 can be formed with a variety of links or sections, and in a variety of sizes as needed for use with different size and/or style hand guards. For example, the locking element 31 generally will include an elongated body, which can range, for example, from approximately 0.4 inches to approximately 1 inch in length, although greater or lesser lengths also can be provided as needed without departing from the scope of the present disclosure. The elongated body of the locking element 31 generally will have a substantially oval or elliptical construction of varying widths. Other shapes or configurations, such as substantially conical, frusto conical, square, triangular and/or rectangular also can be used.

As generally illustrated in FIGS. 4A, 4B and 5A-5C, the body 50 of the locking element 31 generally can include a first, rear, base or distal portion 51, and a substantially conically or cylindrically shaped forward, second or proximal end section 52. The rear, base section or head 53 of the locking element body 50 optionally can generally have a substantially oval or oblong configuration including flattened side portions 53A/53B. As indicated in FIGS. 2A and 2B, when the locking element 31 is received within a corresponding locking aperture or bore 55 formed within the hand guard 10, these flattened surfaces 53A and 53B can be configured to substantially engage and mate with corresponding side surfaces 56 of the locking aperture 55 to help fix the locking element in a desired position for engagement by the fastener 32, as well as to help guide the locking element 31 into and through the locking aperture 55 of the hand guard 10. Alternatively, the head 53 of the locking element 31 and the corresponding surfaces 56 of the locking aperture 55 can be substantially round, as will be discussed in greater detail below.

As further illustrated in FIGS. 4A, 4B and 5A-5C, the forward tapering portion 52 of the locking element 31 can be formed with a substantially conical or frusto conical, forwardly tapering front gauging surface 57. For example, the inwardly tapering or sloping surface 57 can be formed at a variety of angles Θ, for example extending from about 5° to about 20-25°, and generally will be configured to act as a secondary interfacing surface having a substantially operative slope or angle that will generally mate with the first interfacing surface defined by the sloped shoulder section or surface 47 (FIG. 2A) of the barrel nut 30. Various other angles or configurations also can be used without departing from the scope of the present disclosure, with the configuration of the forwardly extending, tapering section 52 of the locking element generally being provided with a substantially cooperative slope or configuration to match the corresponding sloped shoulder surface 47 of the barrel nut. As additionally shown in FIG. 4B, a reduced diameter section 58 also can be provided between the forwardly tapering section 52 and rear or base section 51 of the locking element to provide additional surface contact as needed for engaging the hand guard 10 and/or barrel nut 30 during operation.

As further shown in FIGS. 4A-5D, a central bore 60 generally will be formed within the locking element 31. The central bore 60 can extend at least partially into, and in some embodiments entirely through, the body 50 of the locking element 31, generally extending along a central axis C (FIGS. 4B and 5C). The central bore 60 of the locking element 31 will be sized and configured to receive the fastener 32 therein, as illustrated in FIG. 2B. The fastener 32 can include screws, bolts or other, similar types of fasteners, typically including a threaded shank 62 having a helical thread or teeth 63 formed thereabout and with a head 64 generally formed at one end of the shank. The central bore 60 of the locking element 31 likewise can be threaded, at least partially along its length, as indicated at 66 in FIG. 2B, at least partially along its length, or can be otherwise configured to engage the fastener 32.

As generally illustrated in FIG. 2B, after the barrel nut 30 has been installed on the upper receiver 11 of the firearm, and the barrel 12 received therein, the hand guard 10 can be installed, typically in a position abutting or engaging the upper receiver 11, engaging the barrel nut 30. The lengthwise passage 25 of the barrel nut 30 generally will include an inner diameter ID that substantially matches the outer diameter OD1 of the barrel nut 30 such that the hand guard 10 can be fitted over the barrel nut 30 with the inner surfaces of the lengthwise passage 25 of the hand guard 10 generally engaging the outer surfaces of the barrel nut 30 in at least a minimal frictioned fit (e.g., interference fit) so as to provide additional stability for the mounting of the hand guard 10 over the barrel nut 30 with the barrel 12 generally being in a substantially floating type of arrangement.

With the hand guard 10 fitted over and thus supported on the barrel nut 30, the locking element 31 can be inserted into the mating recess 55 of the hand guard 10, while the fastener 32 will be inserted through a fastener bore 67 extending through the opposite outer side of the hand guard 10 as indicated in FIG. 2B. The fastener bore 67 may be any suitably shaped hole or opening. Reiterating from above, the mating recess 55 and fastener bore 67 of the hand guard 10 may be respectively referred to as first and second parts or holes of a crosswise passage 70 of the hand guard 10. In the first embodiment, the at least one crosswise passage 70 extends through a lower portion 72 of the body of the hand guard 10. The lower portion 72 of the body of the hand guard may, for example, define a base of the hand guard, a lower rib or a portion of a lower rib of the hand guard, a lower rail or a portion of a lower rail of the hand guard, and/or a lower grip or a portion of a lower grip of the hand guard, such as discussed below.

The shank of the fastener 32 will be received within the central bore 60 of the locking element 31, and as the fastener 32 is tightened into farther engagement with the locking element 31, the locking element 31 will be drawn toward the fastener 32 and toward a position in engagement with the barrel nut 30. The fastener 32 can be tightened into farther engagement with the locking element 31 by causing relative rotation between the fastener and the locking element, or more specifically by rotating the fastener relative to the locking element. In response to the relative rotation, the threads 63, 66 cooperatively act to draw the locking element 31 and fastener 32 toward one another. However, the head 64 of the fastener defines a shoulder for engaging against a corresponding arresting shoulder 74 of the hand guard 10, for restricting or arresting travel of the fastener 32 farther into the crosswise passage 70. As a result, the locking element 31 can be drawn toward the fastener 32 and against the barrel nut 20.

As illustrated in FIG. 2B, the sloped or tapered interfacing surface 57 of the conical or tapered front portion 52 of the locking element 31 will engage and bear against the corresponding tapered or conical shoulder section or surface 47 (e.g., the first interfacing surface) of the barrel nut 30 as the locking element 31 is drawn at least farther into the mating locking recess 55 of the hand guard 10 by its engagement with the fastener 32. In this regard, the hand guard's crosswise passage 70, which includes mating recess 55 and fastener bore 67, also can include or will be associated with a connecting opening 76 extending or otherwise located between the lengthwise and crosswise passages 25, 70 of the hand guard 10. The interfacing surface 57 of the locking element 31 further can extend at least partially though the connecting opening 76 in order to engage against the interfacing surface 47 of the of the barrel nut 30.

The locking element 31 accordingly acts as a wedge so as to provide a clamping force between the barrel nut 30 and the hand guard 10 so that the hand guard 10 is urged against the outer diameter OD1 or surface of the barrel nut 30 to secure the hand guard 10 in place. The interaction of the corresponding tapered or conical interacting surfaces of the barrel nut 30 and locking element 31 further can generate a directional force that helps locate and align the hand guard 10 as the hand guard 10 is secured and mounted against or proximate the upper receiver 11 of the firearm and along the barrel nut 30. The design of the interface between the locking element 31 and corresponding interfacing surfaces 47 of the barrel nut 30 can cause the hand guard 10 to be locked in a position relative to the receiver, with an asymmetrical geometry, while eliminating undesired degrees of freedom of movement of the hand guard 10, and further providing a directional force that draws the hand guard 10 against the barrel nut 30 in both a downward and rearward direction as torque is applied to the fastener 32.

In accordance with the first embodiment, the locking element 31 and the fastener 32 will comprise parts of a fastener assembly that can be at least partially positioned in each of the lengthwise passage 25, the crosswise passage 70 and the connector opening 76 between the crosswise passage and the lengthwise passage such that at least a portion of the fastener assembly is wedged between portions of the hand guard 10 and the barrel nut 30 for providing at least one mounting force between the hand guard and the barrel nut. Further, while the fastener assembly of the present embodiment is shown with the locking element 31 and the fastener 32 as described herein, the fastener assembly alternatively may include other fastener(s), locking element(s), wedge or inclined surface(s), and/or the like.

In the first embodiment, a method for mounting the hand guard 10 to at least the barrel nut 30 can comprise causing relative movement between the hand guard and the barrel nut so that the barrel nut is at least partially received in the lengthwise passage 25 of the hand guard, and then providing at least one mounting force between the hand guard and the barrel nut while the barrel nut is at least partially positioned in the lengthwise passage of the hand guard. The interfacing surfaces 47, 57 and/or other suitable surface(s) can be configured so that the hand guard attachment mechanism 5 provides the at least one mounting force between the hand guard 10 and the barrel nut 30, and the at least one mounting force includes both axial and radial mounting force components.

The at least one mounting force provided by the attachment mechanism 5 thus can be resolved or otherwise be theoretically divided into a pair of independent vectors or force components that extend at right angles to each other. One of the components of the pair of force components is an axial force component that extends substantially parallel to the longitudinal axis L so as to extend along the lengthwise passage 25 of the hand guard 10. In contrast, the other force component of the pair of force components is a radial force component that extends toward and substantially perpendicular to the longitudinal axis L. The radial force component may be referred to as a substantially radial mounting force that can be for substantially radially forcing an inner surface of the hand guard 10 against an outer surface of the barrel nut 30 and/or radially forcing together any other suitable structures. The axial force component may be referred to as a substantially axial mounting force that can be for substantially axially forcing the rear end of the hand guard 10 against or proximate the front end of the upper receiver 11 and/or axially forcing together any other suitable structures. In one example, the rear end of the hand guard 10 is forced into opposing face-to-face contact with the front end of, or any other suitable portion of the upper receiver 11. In another example, the proximal end 36 of the barrel nut 30 can include a second shoulder, radially outwardly extending flange or any other suitable structure against which the rear end of the hand guard 10 is forced into opposing face-to-face contact by the axial force.

The hand guard installation mechanism 5 accordingly can provide a simplified attachment of a hand guard 10 to a firearm F, without requiring a direct connection of the hand guard 10 to the receiver and/or barrel nut 30. The hand guard installation mechanism 5 further may be operated with the use of a single locking element and single fastener, although additional locking elements and/or fasteners also can be used as needed or desired, thus providing a substantially single point of attachment that enables the hand guard 10 to be securely and efficiently mounted to the receiver of the firearm F in a secure, substantially rigid and aligned position abutting the forward end of the upper receiver 11; as well as enabling the simple and efficient disconnection of the hand guard 10 from the upper receiver 11 as needed, simply by removal of a single or minimal number of fasteners 32. The hand guard installation mechanism 5 further does not require removal of the barrel 12 or barrel nut 30 and/or use of special tools or operations for the disconnection and remounting of the hand guard 10 to the firearm.

FIGS. 6A-8B illustrate (e.g., may at least partially schematically illustrate) a second embodiment of a hand guard 100 that can be used/installed with the hand guard installation mechanism 5 according to the principles of this disclosure. The second embodiment can include a construction and operation similar to the first embodiment, except for variations noted and variations that will be apparent to those of ordinary skill in the art.

The hand guard 100 of the embodiment of FIGS. 6A-8B generally is shown with a substantially cylindrical body 101 that can be made from various metal and/or synthetic materials, such as aluminum, etc. The hand guard 100 can include a substantially cylindrical inner wall 102 defining an inner passage or bore 103 through which the barrel of the firearm will extend. The bore 103 of the hand guard 100 also can include a radiused slot recess 104 extending along the length thereof which can receive a gas tube such as for a gas impingement system of a firearm. As additionally shown in FIGS. 8A and 8C, the central bore 103 of the hand guard 100 can be formed with a stepped profile having an enlarged recess area 106 formed at one end thereof, and which generally will be adapted to receive the barrel nut 30 therein. For example, the inner diameter of the recessed section 106 of the bore 103 can substantially match the outer diameter OD1 of the barrel nut so as to provide a mating engagement therewith to support the hand guard 100 from the barrel nut as discussed above.

Figure 7A:
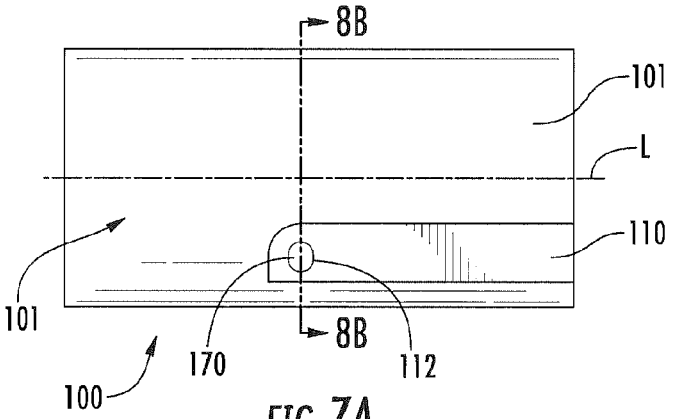
FIG. 7A is a side view of the hand guard of FIGS. 6A-6B.
Figure 7B:
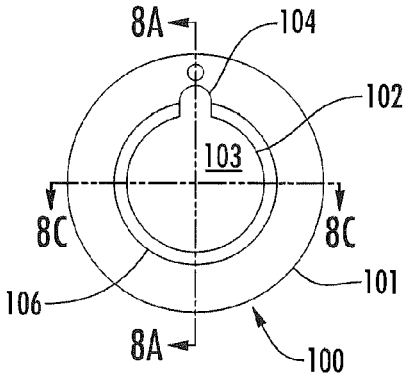
FIG. 7B is an end view of the hand guard of FIGS. 6A-6B.
Figure 8A:
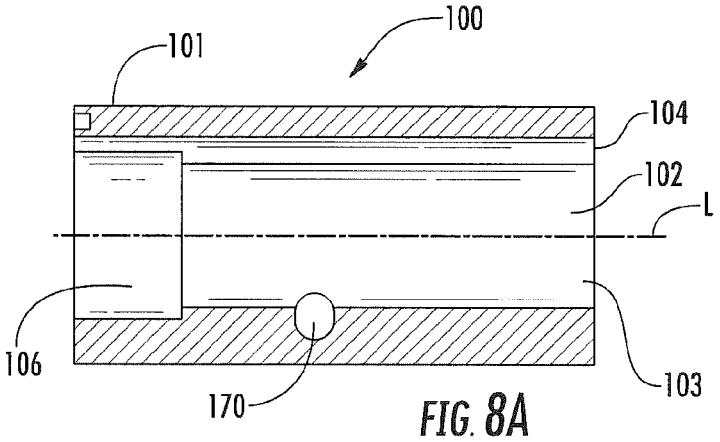
FIG. 8A is a cross-sectional view of the hand guard taken along line 8A-8A of FIG. 7B.
Figure 8B:
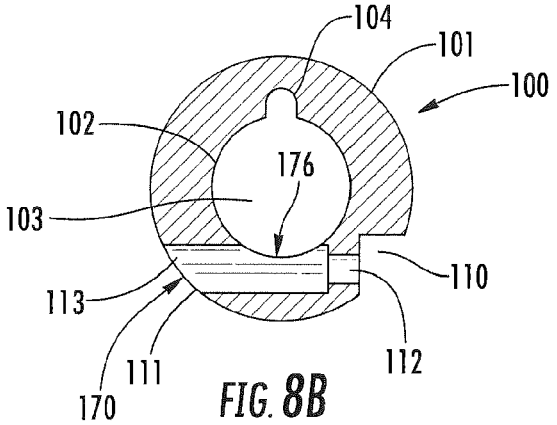
FIG. 8B is a cross-sectional view of the hand guard taken along line 8B-8B of FIG. 7A.
Figure 8C:
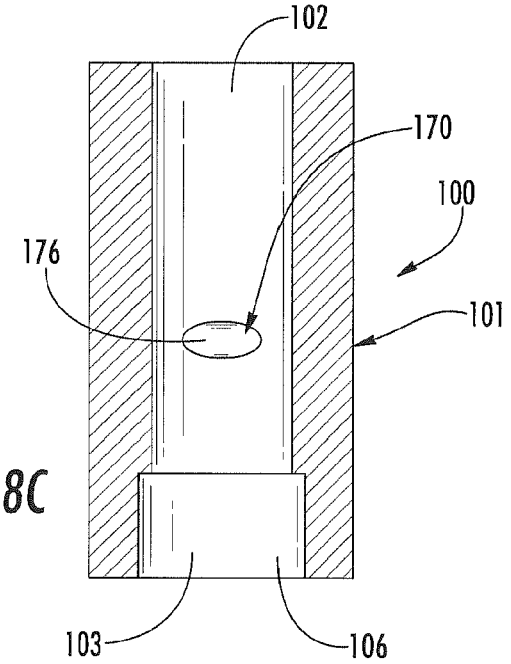
FIG. 8C is a cross-sectional view of the hand guard taken along line 8C-8C of FIG. 7B.

As shown in FIGS. 7A and 8B, a recessed slot or channel 110 can be formed along the lower portion of the hand guard 100. Whereas the recess 110 is shown as being elongate and extending along the length of the hand guard 100 in FIG. 7A, the recess 110 also may be substantially round or in any other suitable configuration. A crosswise passage 170 extending through a lower portion of the hand guard 100 will include a locking aperture, bore or recess 111 (FIG. 8B), wherein the locking aperture 111 can generally extend into the opposite side of the hand guard from the recessed channel area 110 in a direction perpendicular to the longitudinal central axis L (FIGS. 7A and 8A) of the hand guard 100 and barrel nut (when the hand guard is installed over the barrel nut). The crosswise passage 170 can further include a fastener opening 112 (FIG. 8B) formed along the recessed area 110. The locking aperture 111 further will include side surfaces 113 adapted to interface and engage the corresponding side surfaces of the locking element as the locking element is drawn along the locking aperture 111 and into engagement with the barrel nut. The recessed area 110 of the hand guard further enables the head 64 of the fastener 32 to be recessed into the outer side wall of the hand guard as needed or desired. Generally as with the first embodiment, the hand guard's crosswise passage 170, includes locking aperture 111 and fastener opening 112, and can also include or be associated with a connecting opening 176 between the lengthwise and crosswise passages 103, 170 of the hand guard 100. The interfacing surface 57 of the locking element 31 also can extend at least partially though the connecting opening 76 in order to engage against the interfacing surface 47 of the barrel nut 30 substantially in the same manner as discussed above for the first embodiment.

Figure 9:
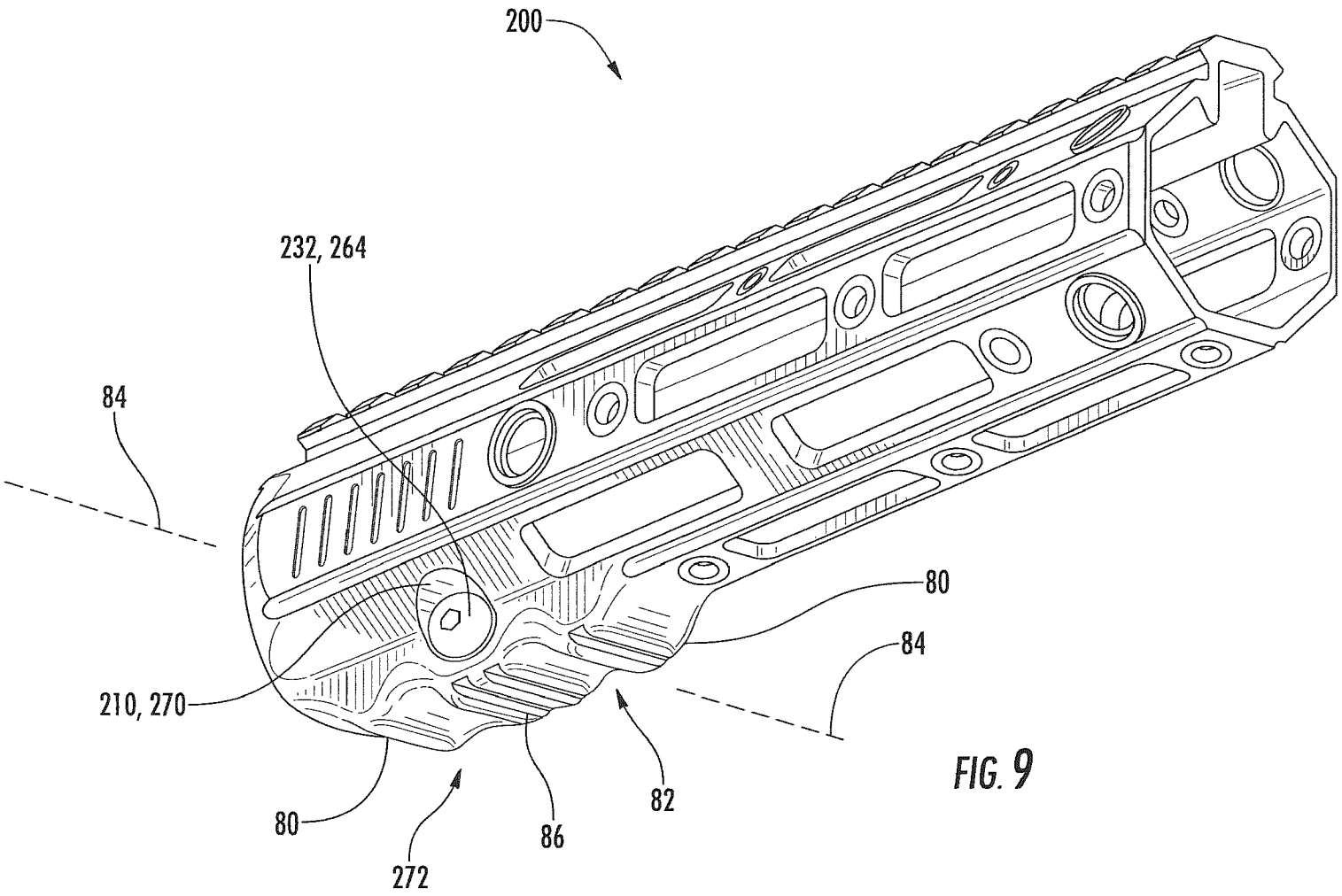
FIG. 9 is a schematic, isolated, bottom perspective view of a hand guard with a fastener mounted therein, in accordance with a third embodiment of this disclosure.
Figure 10:
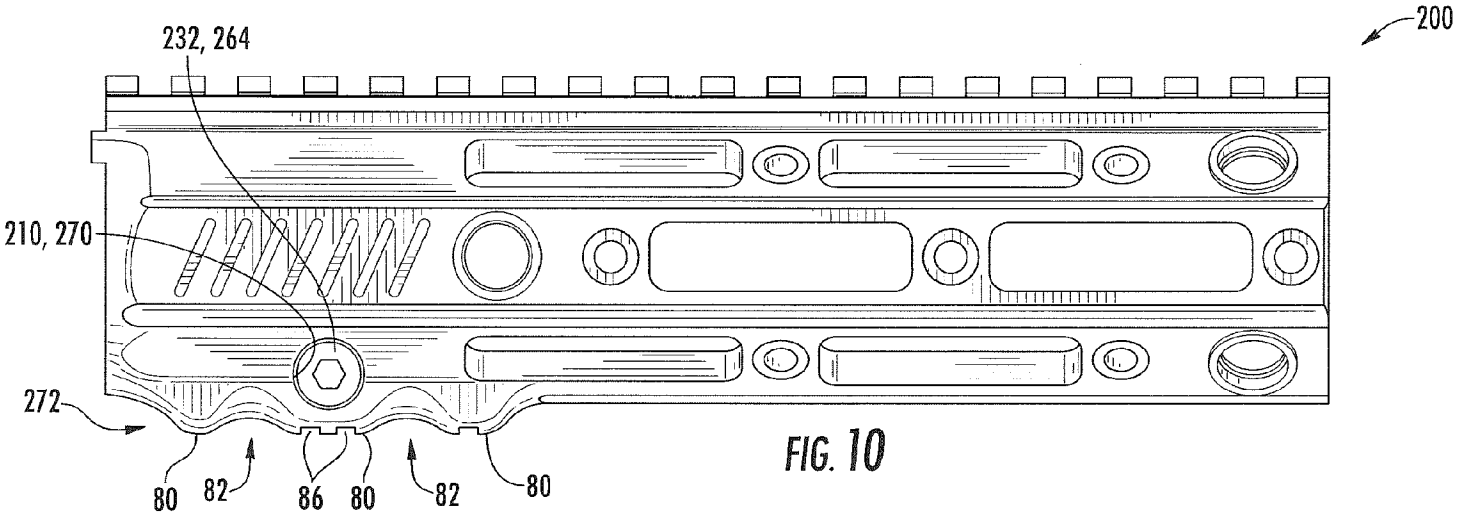
FIG. 10 is a schematic side view of the hand guard of FIG. 9.
Figure 11:
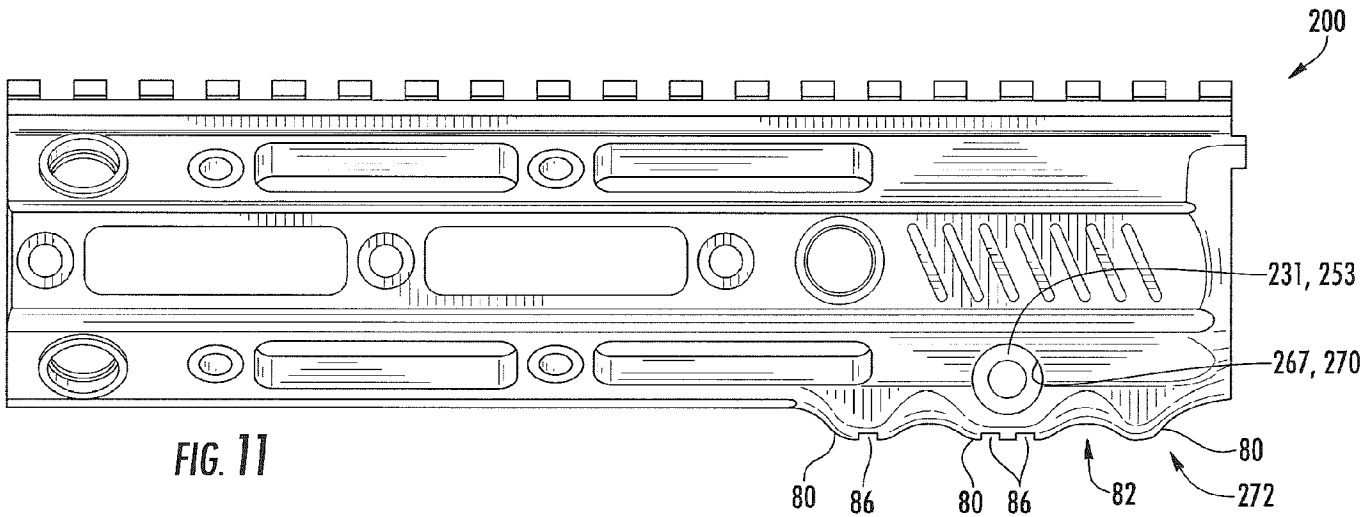
FIG. 11 is an isolated, right side view of the hand guard of FIG. 9 with a locking element mounted therein, wherein the locking element shown in FIG. 11 may include a tapered section for being drawn against the barrel nut in response to operation of the fastener shown in FIGS. 9 and 10.

FIGS. 9, 10 and 11 illustrate a third embodiment of a hand guard 200 that can be used/installed with the hand guard installation mechanism 5 according to the principles of this disclosure. The third embodiment can include a construction and operation similar to the first and second embodiments, except for variations noted and variations that will be apparent to those of ordinary skill in the art.

As shown in FIGS. 9 and 10, the hand guard 200 can include a recessed hole 210 for receiving the head 264 of a fastener 232, here shown as being substantially round. Similarly, and as best understood with reference to FIG. 11, at least a portion of the fastener bore 267 and/or the head 253 of the locking element 231 may optionally be substantially round, in which case the fastener assembly may include one or more additional features for restricting any rotation of the locking element 231 within the fastener bore 267. The fastener bore 267 may be any suitably shaped hole or opening.

Referring to FIGS. 9-11, the lower portion 272 (of the body of the hand guard 200) may at least partially define a crosswise passage 270, and can include a contoured or undulating outer surface 79 that further can at least partially define a series of finger grip protrusions 80 that are spaced apart along the length of the hand guard 200, and finger grip recesses 82 respectively between pairs of the finger grip protrusions. The crosswise passage 270 of the hand guard 200 can be defined or extended through one of these grip protrusions, for example, a central one of the protrusions as shown. A portion of the contoured outer surface 77 that at least partially defines the central finger grip protrusion 80 can extend substantially arcuately about an axis 84 extending crosswise to the length of the hand guard 200, and the crosswise passage 270 can extend substantially or generally coaxially with, or substantially or generally parallel to, the axis 84. Knurling features 86 such as one or more crosswise flutes, ridges or other features also may be formed in one or more of the finger grip protrusions 80 in a manner that further seeks to facilitate gripping of the hand guard by a user's hands or fingers.

In addition, while the hand guards 10, 100, 200 are illustrated in the figures as generally having a substantially cylindrical construction and/or including an integrated Picatinny rail formed therealong, which rail can be aligned with and its rear or proximal end placed into mating contact with the forward or proximal end of a corresponding Picatinny mounting rail formed along or mounted to the upper receiver, it will be understood by those skilled in the art that the hand guards can be formed in a variety of shapes or configurations. The hand guards further can include or have mounted thereto various different accessories or features, including multiple rails arranged at various locations about the body of the hand guard, and/or further can include a series of slots or vent openings to enable air to pass through the hand guard.

Numerous other variations are also within the scope of this disclosure. For example, the hand guard attachment mechanism may not include a barrel nut. In one example, rather than including any barrel nut, a structure that is in some ways similar to the barrel nut 30 may be formed as an integral part of the forward receiver 11, or the like. In one embodiment, the forward receiver 11 may include a substantially cylindrically shaped forward mounting section for mating with the inner diameter of the hand guard 10, and that cylindrically-shaped forward mounting section of the receiver may include a first shoulder like the shoulder 47 for interacting with the locking element 50. Such a receiver may include a secondary shoulder, radially outwardly extending flange or any other suitable structure adapted to function as a stop surface for arresting axial movement of the hand guard relative to the receiver during wedging of the locking element 50 against the first shoulder. Both the cylindrically-shaped forward mounting section of the receiver discussed immediately above and the barrel nut 30 may be generally referred to as mounting structure.

The foregoing description generally illustrates and describes various embodiments of the present invention. The examples given above are merely illustrative and are not meant to be an exhaustive list of all possible designs, aspects, applications or modifications of the present disclosure. It will, therefore, be understood by those skilled in the art that while the present disclosure has been described in terms of exemplary aspects, the present disclosure can be practiced with various changes and modifications which can be made to the above-discussed construction of the present invention without departing from the spirit and scope of the invention as disclosed herein, and that it is intended that all matter contained in the above description or shown in the accompanying drawings shall not to be taken in a limiting sense.

Furthermore, the scope of the present disclosure shall be construed to cover various modifications, combinations, additions, alterations, etc., to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention.

What is claimed is:

1. A hand guard attachment mechanism for mounting a hand guard to a receiver of a firearm, the hand guard attachment mechanism comprising:

a barrel nut having a proximal end adapted to be mounted to the receiver of the firearm, a distal end configured to receive and mount the barrel of the firearm to the receiver, and a shoulder section defined between the proximal and distal ends;

at least one locking element comprising a body having a tapered section at least partially received through a crosswise passage defined through a portion of the hand guard, wherein the at least one locking element is adapted to interface with the shoulder section of the barrel nut, the body of the at least one locking element further including a bore extending at least partially therethrough; and a fastener for extending into the crosswise passage of the hand guard and for being at least partially received within the bore of the at least one locking element;

wherein at least the fastener and the at least one locking element are cooperatively configured so that engagement of the fastener within the bore of the at least one locking element draws the tapered section of the at least one locking element at least farther into interfacing engagement with the shoulder section of the barrel nut; and wherein the barrel nut comprises an outer surface for mating with an inner surface of the hand guard.

2. The hand guard attachment mechanism of claim 1, wherein the hand guard further comprises a lengthwise passage in which a barrel of the firearm is at least partially received; and wherein the crosswise passage of the hand guard has a central axis, the lengthwise passage of the hand guard has a central axis, and the central axis of the crosswise passage extends substantially perpendicularly to the central axis of the lengthwise passage of the hand guard.

3. The hand guard attachment mechanism of claim 1, wherein the crosswise passage of the hand guard is positioned adjacent a proximal end of the receiver, and wherein the bore of the at least one locking element has a central axis extending substantially perpendicular to a central axis of the barrel nut.

4. The hand guard attachment mechanism of claim 1, wherein the bore of the at least one locking element comprises a threaded passage for receiving a threaded shaft of the fastener.

5. A firearm comprising:

a receiver;

a barrel mountable to the receiver;

a hand guard releasably mountable to the receiver, the hand guard including at least one crosswise passage extending at least partially through a portion of the hand guard, and a lengthwise passage extending along a longitudinal axis of the hand guard and through which the barrel is at least partially received, wherein the crosswise passage extends crosswise to the longitudinal axis of the hand guard, and the hand guard further comprises an opening between the crosswise passage and the lengthwise passage;

a barrel nut configured for at least partially mounting the barrel to the receiver; and at least one locking element at least partially received within both the crosswise passage and the opening between the crosswise passage and the lengthwise passage, the at least one locking element comprising a tapered section that is wedged between portions of the hand guard and the barrel nut for providing at least one mounting force between the hand guard and the barrel nut, wherein the fastener, the hand guard and the barrel nut are cooperatively configured so that the at least one mounting force comprises a substantially axial mounting force between the hand guard and the barrel nut.

6. The firearm of claim 5, wherein the at least one locking element, the hand guard and the barrel nut are cooperatively configured so that the at least one mounting force further comprises a substantially radially directed mounting force between the hand guard and the barrel nut.

7. The firearm of claim 5, wherein the barrel nut comprises a shoulder; and wherein the tapered section of the at least one locking element is configured to wedge between the shoulder of the barrel nut and a surface of the hand guard that at least partially defines the crosswise passage.

8. The firearm of claim 5, wherein the crosswise passage comprises openings on opposite outer sides of the portion of the hand guard.

9. The firearm of claim 5, wherein:

the crosswise passage comprises first and second holes respectively proximate opposite outer sides of the portion of the hand guard;

the first hole is configured to at least partially receive the at least one locking element; and the second hole is configured to at least partially receive a shank of a fastener.

10. The firearm of claim 9, wherein:

the bore of the at least one locking element comprises a threaded passage;

the fastener comprises a shoulder, and the shank of the fastener is at least partially threaded;

the portion of the hand guard comprises a shoulder extending at least partially around and at least partially defining an opening to the second hole; and the shoulders are for being engaged to one another so that the tapered section is drawn at least farther into the opening between the crosswise passage and the lengthwise passage, and at least more forcefully engages against the barrel nut, in response to the shank of the fastener being screwed into the threaded passage of the at least one locking element.

11. The firearm of claim 5, wherein the portion of the hand guard comprises a lower portion of the hand guard, and the lower portion of the hand guard comprises a contoured outer surface that at least partially defines a plurality of finger grip protrusions.

12. A hand guard for a firearm, the hand guard comprising:

a body having opposite proximal and distal ends;

a lengthwise passage extending along a length of the hand guard and configured to at least partially receive a barrel of the firearm;

at least one crosswise passage extending through a portion of the body of the hand guard, the crosswise passage extending crosswise to the length of the hand guard, the crosswise passage having openings on opposite outer sides of the body of the hand guard and configured for at least partially receiving a fastener assembly therein; and an opening defined between the crosswise passage and the lengthwise passage sufficient to enable at least a portion of the fastener assembly to project into the lengthwise passage for securing the hand guard to the firearm, wherein the fastener assembly comprises at least one locking element comprising a body having a tapered section for being at least partially received in both the crosswise passage and the lengthwise passage, the body further including a bore extending at least partially thereinto, and a fastener extending into the crosswise passage and at least partially received within the bore of the body.

13. The hand guard of claim 12, wherein:

at least a portion of the crosswise passage extends beneath the lengthwise passage; and the opposite outer sides of the portion of the body of the hand guard comprise opposite right and left sides of the portion of the body of the hand guard, so that the crosswise passage has an opening at the right side of the portion of the body of the hand guard, and the crosswise passage has an opening at the left side of the portion of the body of the hand guard.

14. The hand guard of claim 12, wherein the portion of the body of the hand guard comprises a lower portion of the hand guard, and the lower portion of the hand guard comprises an undulating outer surface that at least partially defines a plurality of finger grip protrusions and at least one finger grip recess between a pair of finger grip protrusions of the plurality of finger grip protrusions.

15. The hand guard of claim 14, wherein a finger grip protrusion of the pair of finger grip protrusions at least partially defines the at least one crosswise passage.

16. The hand guard of claim 14, wherein:

a portion of the undulating outer surface that at least partially defines a finger grip protrusion of the pair of finger grip protrusions extends substantially arcuately about an axis extending crosswise to the length of the hand guard; and the crosswise passage extends substantially coaxially with the axis extending crosswise to the length of the hand guard.

17. The combination of claim 12, wherein:

the crosswise passage comprises first and second holes respectively proximate the opposite outer sides of the portion of the body of the hand guard;

the first hole is for at least partially receiving the tapered section of the at least one locking element; and the second hole is for at least partially receiving a shank of fastener.

18. A method for mounting a hand guard to at least a barrel nut, comprising:

causing relative movement between the hand guard and the barrel nut so that the barrel nut is at least partially received in a lengthwise passage of the hand guard; and providing at least one mounting force between the hand guard and the barrel nut while the barrel nut is at least partially positioned in the lengthwise passage of the hand guard, wherein:

the at least one mounting force comprises a substantially axial mounting force between the hand guard and the barrel nut, and the substantially axial mounting force is directed in a direction that extends along the lengthwise passage of the hand guard, and the providing of the at least one mounting force between the hand guard and the barrel nut is comprised of wedging between the hand guard and the barrel nut, so that the wedging at least partially causes the axial mounting force between the hand guard and the barrel nut.

19. The method of claim 18, further comprising the axial mounting force at least partially causing the hand guard to be forced against a receiver of a firearm.

20. The method of claim 18, wherein the wedging is comprised of wedging a tapered section of at least one fastener assembly between the hand guard and the barrel nut.

21. The method of claim 20, wherein the wedging of the tapered section is comprised of drawing the tapered section at least farther into a crosswise passage of the hand guard and at least into more forceful engagement with a shoulder of the barrel nut.

22. The method of claim 21, further comprising respectively introducing a locking element and a fastener into an opposite openings of a crosswise passage of the hand guard, wherein the locking element comprises the tapered section;

the wedging of the tapered section is comprised of drawing the tapered section at least farther into the crosswise passage of the hand guard and at least into more forceful engagement with the barrel nut; and the drawing the tapered section at least farther into the crosswise passage is comprised of causing relative rotation between the locking element and the fastener.

23. The method of claim 21, wherein:

the at least one mounting force further comprises a substantially radial mounting force between the hand guard and the barrel nut, and the substantially radial mounting force is directed in a direction that extends crosswise to the lengthwise passage of the hand guard; and the wedging at least partially causes the radial mounting force between the hand guard and the barrel nut.

24. A hand guard attachment mechanism for mounting a hand guard to a firearm, the hand guard attachment mechanism comprising:

a mounting structure comprising a shoulder;

at least one locking element comprising a body having a tapered section at least partially received in a crosswise passage defined through a portion of the hand guard, wherein the at least one locking element is adapted to interface with the shoulder of the mounting structure, the body of the at least one locking element further including a bore extending at least partially therethrough; and a fastener for extending into the crosswise passage of the hand guard and for being at least partially received within the bore of the at least one locking element;

wherein at least the fastener and the at least one locking element are cooperatively configured so that engagement of the fastener within the bore of the at least one locking element draws the tapered section of the at least one locking element at least farther into interfacing engagement with the shoulder of the mounting structure; and wherein the mounting structure comprises an outer surface for mating with an inner surface of the hand guard.

25. The hand guard attachment mechanism of claim 24, wherein:

the hand guard further comprises a lengthwise passage in which a barrel of the firearm is at least partially received;

the crosswise passage extends crosswise to the lengthwise passage;

the hand guard further comprises an opening between the crosswise passage and the lengthwise passage; and the at least one locking element extends at least partially through the opening between the crosswise passage and the lengthwise passage so that the tapered section of the at least one locking element is wedged against the shoulder of the mounting structure.

* * * * *